US006240715B1

(12) United States Patent
Bruss et al.

(10) Patent No.: US 6,240,715 B1
(45) Date of Patent: Jun. 5, 2001

(54) CENTRIFUGAL SPINNING MACHINE AND METHOD FOR CENTRIFUGAL SPINNING

(75) Inventors: Karl-Heinz Bruss; Karl Koltze, both of Mönchengladbach; Michael Sopalae, Dinslaken, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/499,432

(22) Filed: Feb. 7, 2000

(30) Foreign Application Priority Data

Feb. 12, 1999 (DE) ..... 19 05 859

(51) Int. Cl.[7] ..... D01H 7/88
(52) U.S. Cl. ..... 57/77; 57/76
(58) Field of Search ..... 57/281, 312, 76, 57/77

(56) References Cited

U.S. PATENT DOCUMENTS

| | | | |
|---|---|---|---|
| 3,314,223 | 4/1967 | Bobkowicz . | |
| 5,385,007 | 1/1995 | Hartel et al. | 57/76 |
| 5,515,672 | 5/1996 | Koltze et al. | 57/281 |

FOREIGN PATENT DOCUMENTS

| | | |
|---|---|---|
| 323 562 | 9/1957 | (CH) . |
| 41 02 549 A1 | 7/1992 | (DE) . |
| 42 08 039 A1 | 9/1993 | (DE) . |
| 42 36 379 A1 | 5/1994 | (DE) . |
| 43 24 039 A1 | 1/1995 | (DE) . |
| 195 48 675 A1 | 6/1997 | (DE) . |
| 0 498 171 | 8/1992 | (EP) . |

*Primary Examiner*—Danny Worrell
(74) *Attorney, Agent, or Firm*—Kennedy Covington Lobdell & Hickman, LLP

(57) ABSTRACT

A centrifugal spinning machine having at least one spinning station (10), each of which has one rotatable spinning centrifuge (14), one yarn guide (18) that can be supplied with a fibrous spinning strand (26'), and one drive device (38) for generating an axial motion between the yarn guide (18) and the spinning centrifuge (14). The yarn (26) is guided in the yarn guide (18) to travel through the rotational axis of a rotor 46 of the drive device (38).

8 Claims, 1 Drawing Sheet

CENTRIFUGAL SPINNING MACHINE AND METHOD FOR CENTRIFUGAL SPINNING

FIELD OF THE INVENTION

The present invention relates to a spinning machine and method for producing yarn by centrifugal spinning, also known as pot spinning.

BACKGROUND OF THE INVENTION

A centrifugal or pot spinning machine and method are known for instance from German Patent Disclosures DE 42 08 039 A1 and DE 43 24 039 A1. Such centrifugal spinning machines as a rule include many spinning stations, each of which has one rotatable spinning centrifuge. Such spinning stations are supplied with sliver via a sliver drafting device, preferably a drafting roller mechanism, from which the drafted sliver is spun into a yarn by the action of the spinning centrifuge as it rotates about its center axis. In the process, the yarn passes through a tubular yarn guide and emerges from its orifice, and therefrom the yarn is applied to the inner wall of the spinning centrifuge in layers, forming a so-called spinning cake. This deposition of the spinning cake is accomplished by generating a relative motion, also known as a shogging motion, between the yarn guide and the spinning centrifuge in the axial direction which is generated by a drive device for the yarn guide and/or for the spinning centrifuge. Once the spinning process is completed, or a predetermined amount of yarn is placed in the spinning centrifuge , the yarn cake spun to that time is wound onto a rewinding tube held in readiness on the yarn guide.

From German Patent Disclosure DE 41 02 549 A1, a ring spinning apparatus is known, with a drive device for generating an axial motion between a rotor revolving on a spinning ring and a yarn carrier disposed on a spindle roving frame. The drive device includes a lifting carriage, for instance, which can be shifted by a spindle arrangement. The spindles are driven preferably by an electric motor. In these known drive devices, it is disadvantageous that a relatively complicated arrangement has to be provided, which requires a relatively large amount of space. In addition, the drive spindles are located in an open exposed disposition where they tend to become heavily covered with lint and debris, especially in the environment of a spinning mill, and hence the spindles need a relatively large amount of maintenance.

SUMMARY OF THE INVENTION

It is accordingly an object of the present invention to provide an improved centrifugal spinning apparatus and method which overcomes the aforementioned problems and disadvantages. More particularly, an object of the present invention is to provide a centrifugal spinning apparatus and method with which a relative motion can be attained between a yarn guide and a spinning centrifuge in a simple manner.

According to the invention, this object is attained by a centrifugal spinning machine having at least one spinning station comprising a rotatable spinning centrifuge, a yarn guide arranged to receive a fibrous spinning strand (e.g., a sliver, roving or the like), and a drive device for generating relative motion axially between the yarn guide and the spinning centrifuge for causing the fibrous spinning strand upon emerging from the yarn guide to be spun into a yarn and deposited on an inside wall of the spinning centrifuge in the form of a spinning cake. According to the present invention, the drive device includes a rotor disposed about a rotational axis and the yarn guide is oriented to cause the fibrous spinning strand guided thereby to travel through the rotational axis of the rotor of the drive device.

Because the yarn guided in the yarn guide runs through the rotational axis of the rotor of the drive device, a very compact design is possible. Thus, the provision of intermediate transmission members can be eliminated, which not only saves space but also considerably simplifies assembly.

Because of the reduction of the mass that has to be driven, the energy input for generating a relative motion between the yarn guide and the spinning centrifuge is minimized, which increases the effectiveness of the entire centrifugal spinning device.

In a preferred feature of the invention, the drive device is an electric motor, whose rotor is operatively connected directly to the yarn guide, and preferably the rotor is a cylinder, which receives the yarn guide by positive engagement. As a result, a transmission of the driving energy of the electric motor to the yarn guide is made possible in an especially simple way, since the rotor of the electric motor acts directly on the yarn guide. In particular, this makes a very precise positioning of the yarn guide possible, since tolerance errors, slip errors or the like are avoided because of the lack of intervening transmission members.

An advantageous embodiment is obtained if the rotor of the electric motor has internal teeth that mesh with external teeth of the yarn guide. This arrangement provides a secure, positive connection between the rotor and the yarn guide. The relative motion of the yarn guide with respect to the spinning centrifuge can be adjusted in an exactly replicable manner via the male thread of the yarn guide and the corresponding female thread of the rotor.

It is also a preferred feature of the invention that the electric motor is a stepping motor. As a result, by a suitable defined triggering of the stepping motor, an exact positioning or an exact axial shifting of the yarn guide relative to the spinning centrifuge can be achieved. A proportional shifting of the yarn guide is effected in accordance with the triggering of the stepping motor, so that the spinning cake deposited on the inside circumference of the spinning centrifuge is distinguished by a uniform yarn layer.

The invention also provides a novel and advantageous method of centrifugal spinning yarn. Because the yarn guided in the yarn guide travels through the rotational axis of a rotor of a drive device, and because the yarn guide is acted upon directly by a driving force to produce an axial motion, a very precise relative motion of the yarn guide to the spinning centrifuge can be attained. This direct engagement of the yarn guide by the driving force minimizes any positioning error during the relative motion of the yarn guide. As a result, the quality of the spinning cakes produced can be optimized to a high degree.

Further preferred features, characteristics and advantages of the present invention will be described and understood from a detailed disclosure of an exemplary embodiment of the invention with reference to the accompanying drawings.

DESCRIPTION OF THE PREFERRED EMBODIMENT

Figure 1:
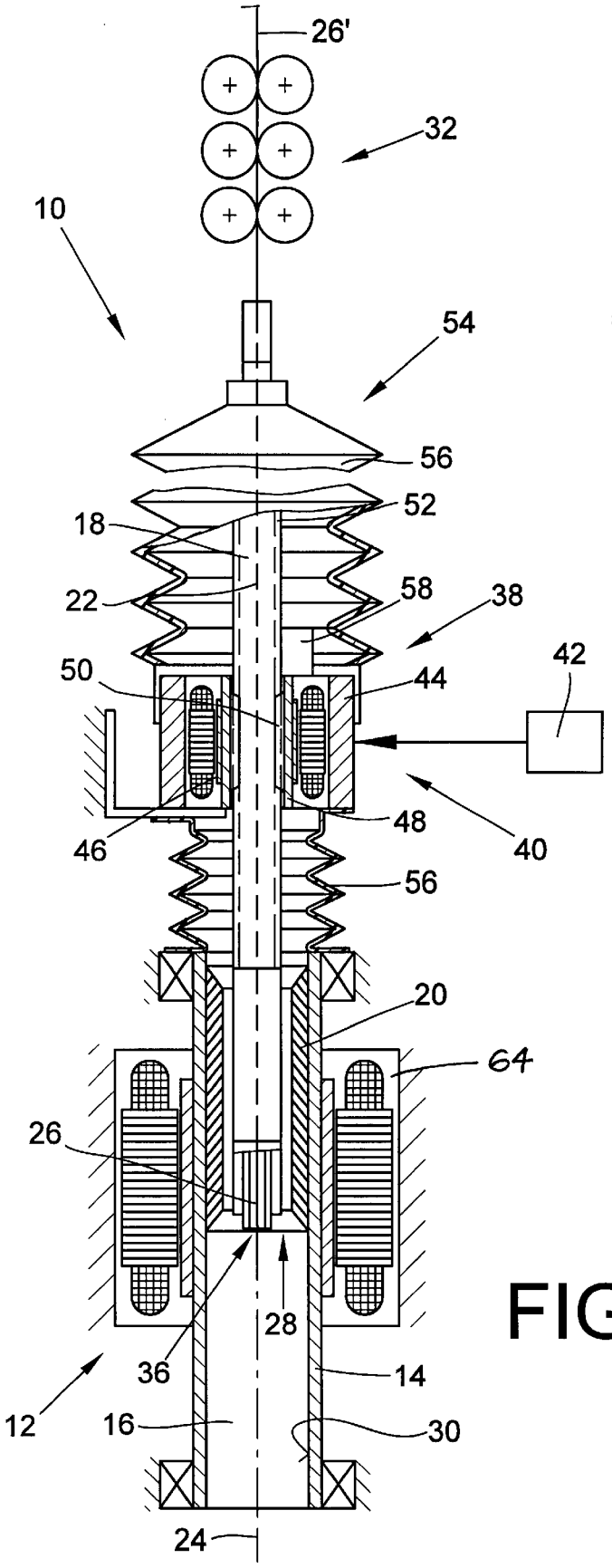
FIG. 1 is a view partially in side elevation and partially in vertical cross-section of a centrifugal spinning station according to a preferred embodiment o f the present invention.

Referring now to the accompanying drawings, a spinning station 10 of a centrifugal or pot spinning machine is shown schematically in FIG. 1. Typically, centrifugal spinning machines have many such spinning stations 10, which are disposed side by side either in rows or in rings. Each spinning station 10 has one centrifugal spinning device 12, which is shown in FIG. 1 in a schematic longitudinal section. The centrifugal spinning device 12 includes a rotatably supported spinning centrifuge 14 into the interior 16 of which extends a yarn guide 18 such that the longitudinal axis 22 of the yarn guide 18 coinciding with the rotational axis 24 of the spinning centrifuge 14.

A sliver or roving 26' drafted in a drafting roller mechanism 32 can be introduced into the spinning centrifuge 14 by the yarn guide 18 and is then spun into a yarn 26 by the action of the rotating spinning centrifuge 14. The yarn 26 emerges laterally from the yarn guide orifice as indicated at 28 and is deposited in the form of a so-called spinning cake on the inside wall 30 of the spinning centrifuge 14.

The yarn guide 18 is equipped with a drive device 38, by which is produced an axial relative motion of the yarn guide 18 and thus of its orifice 16 relative to the spinning centrifuge 14. The relative motion of the yarn guide 18 is effected in a reciprocating fashion, commonly refined to as shogging, while at the same time the yarn guide 18 is progressively shifted downwardly somewhat so that the spinning cake 20 has the form of a so-called cop winding.

The drive device 38 is preferably embodied as a stepping motor 40, which can be triggered via a control unit 42. The stepping motor 40 includes a stator 44, supported in stationary fashion, and a rotor 46 rotatably disposed inside the stator. The construction and mode of operation of stepping motors 40 are well known, and therefore need not be described in further detail herein.

The rotor 46 is embodied as a cylinder 48, which has a female thread 50 which meshes with a male thread 52 of yarn guide 18. The meshing threads 50 and 52 provide a positive connection between the drive device 38 and the yarn guide 18. The yarn guide 18 itself is fixed against rotation by a torsion preventer 58, which is shown in further detail in FIG. 2.

The manner of operation of the centrifugal spinning device may thus be understood. During operation of the spinning station 10, the spinning centrifuge 14 rotates at high speed (rpm) about the rotational axis 24 as a result of an electric motor drive device 64. Simultaneously, sliver 26, after being initially drafted for instance in the drafting mechanism 32, is fed via the yarn guide 18 into the spinning centrifuge 14. The drafted sliver, upon emerging from the orifice 36 of the yarn guide 18, travels laterally in a revolving yarn segment 28 from the orifice 36 of the yarn guide 18 to the inner wall 30 of the spinning centrifuge 40 under the influence of the rotary motion of the spinning centrifuge 14 and in the process is spun into a yarn 26, after which the yarn 26 is deposited against the inner wall 30 of the spinning centrifuge 14, on which the deposited yarn 26 progressively forms a so-called spinning cake.

In order to form a spinning cake 20 that lends itself as well as possible to rewinding, the yarn 26 is deposited on the inner wall 30 of the spinning centrifuge 15 in the manner of a cop winding, i.e., the yarn guide 18, in a manner known per se, is shogged back and forth constantly by a certain, constant stroke and at the same time is continuously shifted downward somewhat relative to the rotating spinning centrifuge 14. As a result, the orifice 36 of the yarn guide 18 is likewise shifted relative to the inner wall 30 of the spinning centrifuge 14, so that the region of contact of the yarn thread 28 varies accordingly. The yarn deposition technique described above, which leads to the formation of a spinning cake 20 that can be rewound well, is specified via the control unit 42, which actuates the shogging motion of the drive device 38 according to a manual setting or a programmed setting via a microprocessor or other computation unit.

Figure 2:
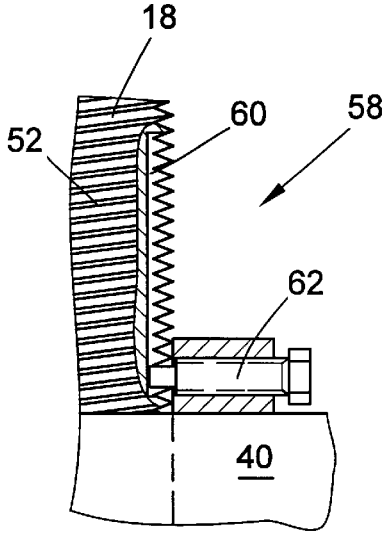
FIG. 2 is an enlarged vertical cross-sectional view of the torsion preventer for the yarn guide of the centrifugal spinning station of FIG. 1.

Depending on the triggering of the drive device 38, preferably the stepping motor 40, the cylindrical rotor unit 46, 48 is caused to rotate and, in turn, because of the positive connection between the female thread 50 of the rotor 46 and the male thread 52 of the yarn guide 18, which is secured against rotation by a torsion preventer 58, an axial shifting of the yarn guide 18 occurs. The torsion preventer 58 can, as indicated in FIG. 2, comprise a longitudinal groove 60 in the region of the male thread 52 of the yarn guide 18, along with a securing element 62. The securing element 62 is fixed against relative rotation on the stator 44 of the stepping motor 40, and thus engages in the longitudinal groove 60.

Because the drive device 38 virtually encompasses the yarn guide 18, only an extremely small amount of space is needed to accommodate the drive device 38. Moreover, in turn, the rotor 46 is effectively operationally connected directly to the yarn guide 18. As a result, it is unnecessary to provide intermediate transmission members. The driving force can thus be initiated directly and precisely. At the same time, the drive device 38 takes on the function of the yarn guide 18 which is supported in quasi-floating fashion by the drive device 38, so that there is no need to provide further bearings or the like.

The centrifugal spinning device 12 is also provided with a covering 54, which is braced on one side on the drive device 38 and on the other on the upper end of the yarn guide 18. The covering 54 has a substantially flexible cylindrical sheath 56, for example, in the form of a bellows, which encompasses the yarn guide 18 above the drive device 38.

The covering 54 assures that the positive connection between the yarn guide 18 and the drive device 38 is effectively sealed. As a result, lint, debris or the like that more or less necessarily occurs during the operation of the centrifugal spinning devices 12 is thusly prevented from settling upon the positive drive connection to impair the function of the drive device 38. Because of the flexibility of the sheath 56, the covering 54 can readily follow along with the reciprocating motion of the yarn guide 18. The sealing is thus assured during every phase of operation of the centrifugal spinning device 12.

In accordance with further exemplary embodiments, not shown, a non-positive connection between the drive device 38 and the yarn guide 18 can also be designed, for instance the drive device 38 may be embodied as a migrating shaft motor, whose actuator is in frictional engagement with the yarn guide 18. As a result, here again, a direct transmission of the driving energy to the yarn guide 18 is made possible in a simple manner.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A centrifugal spinning machine having at least one spinning station comprising a rotatable spinning centrifuge, a yarn guide arranged to receive a fibrous spinning strand, and a drive device for generating relative motion axially between the yarn guide and the spinning centrifuge for causing the fibrous spinning strand upon emerging from the yarn guide to be spun into a yarn and deposited on an inside wall of the spinning centrifuge in a spinning cake, the drive device comprising an electric motor having a rotor disposed about a rotational axis and operatively connected directly to the yarn guide in an orientation to cause the fibrous spinning strand guided thereby to travel through the rotational axis of the rotor of the drive device.

2. The centrifugal spinning machine of claim 1, characterized in that the rotor comprises a cylinder in positive engagement with the yarn guide.

3. The centrifugal spinning machine of claim 2, characterized in that the yarn guide has a male thread and the cylinder has a female thread in meshing engagement with one another.

4. The centrifugal spinning machine of claim 1, characterized in that the drive device is an electric stepping motor.

5. The centrifugal spinning machine of claim 1, characterized in that the yarn guide is axially movable, and the drive device includes a torsion preventer fixing the yarn guide against rotation.

6. The centrifugal spinning machine of claim 1, characterized in that the drive device includes a covering to shield against entry of lint or other debris.

7. The centrifugal spinning machine of claim 6, characterized in that the covering is a flexible cylindrical sheath fitted at least partly around the yarn guide.

8. A method for centrifugal spinning of yarn, comprising the steps of introducing a fibrous spinning strand via a yarn guide into a rotating spinning centrifuge, spinning the strand into a yarn and depositing the yarn on the inside wall of the spinning centrifuge while axially shifting the yarn guide relative to the spinning centrifuge by an electric motor imposing a driving force directly on the yarn guide to form the deposited yarn into a spinning cake and causing the fibrous spinning strand guided by the yarn guide to travel through a rotational axis of a rotor of the electric motor.

* * * * *